US011536222B2

(12) United States Patent
Zhou et al.

(10) Patent No.: US 11,536,222 B2
(45) Date of Patent: Dec. 27, 2022

(54) BLOCK RIBS FOR REDUCING LINER DISTORTION

(71) Applicant: Cummins Inc., Columbus, IN (US)

(72) Inventors: Xiling Zhou, Hubei Province (CN); Vijaysai Karuppiah Kumareshan, Columbus, IN (US); John Jerl Purcell, III, Louisa, VA (US); Mathew A. Clark, Darlington (GB)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 17/351,639

(22) Filed: Jun. 18, 2021

(65) Prior Publication Data

US 2021/0310439 A1 Oct. 7, 2021

Related U.S. Application Data

(63) Continuation-in-part of application No. PCT/US2019/066271, filed on Dec. 13, 2019.

(60) Provisional application No. 62/781,943, filed on Dec. 19, 2018.

(51) Int. Cl.
*F02F 7/00* (2006.01)
*F02F 1/00* (2006.01)

(52) U.S. Cl.
CPC ..... *F02F 7/0021* (2013.01); *F02F 1/004* (2013.01); *F02F 7/0065* (2013.01); *F02F 2001/008* (2013.01)

(58) Field of Classification Search
CPC ..... F02F 7/0021; F02F 1/004; F02F 7/0065; F02F 2001/008; F02F 1/163; F02F 1/16; F02B 75/22
See application file for complete search history.

(56) References Cited

U.S. PATENT DOCUMENTS

| | | | |
|---|---|---|---|
| 3,568,573 | A | 3/1971 | Bailey et al. |
| 3,977,385 | A | 8/1976 | Mansfield |
| 4,016,850 | A | 4/1977 | Bloemers |
| 4,244,330 | A | 1/1981 | Baugh et al. |
| 4,440,118 | A | 4/1984 | Stang et al. |
| 5,357,921 | A | 10/1994 | Katoh et al. |

(Continued)

FOREIGN PATENT DOCUMENTS

| | | |
|---|---|---|
| DE | 102005048537 A1 | 4/2007 |
| EP | 2290216 | 3/2011 |

(Continued)

OTHER PUBLICATIONS

International Search Report and Written Opinion, PCT Appln. No. PCT/US19/66271, dated Mar. 4, 2020, 11 pgs.

(Continued)

*Primary Examiner* — Syed O Hasan

(74) *Attorney, Agent, or Firm* — Taft Stettinius & Hollister LLP

(57) ABSTRACT

An engine block includes one or more cylinder bores at least partially surrounded by a cylinder bore wall. The cylinder bore wall includes a liner stop mechanism to support a liner in the cylinder bore. The engine block has an outer cylinder block wall that is exterior to the cylinder bore wall. The outer cylinder block wall includes at least one rib located relative to the liner stop mechanism to reduce rotation and buckling of the liner during operation of the engine.

19 Claims, 6 Drawing Sheets

(56) References Cited

U.S. PATENT DOCUMENTS

| | | | | |
|---|---|---|---|---|
| 5,404,847 | A | 4/1995 | Han | |
| 5,651,340 | A | 7/1997 | Schwaderlapp et al. | |
| 5,669,346 | A | 9/1997 | Leweux et al. | |
| 5,887,558 | A | 3/1999 | Kampichler et al. | |
| 5,979,374 | A | 11/1999 | Jackson | |
| 5,983,975 | A | 11/1999 | Nilsson | |
| 6,044,821 | A | 4/2000 | Weng | |
| 7,322,320 | B2 * | 1/2008 | Sugano | F02F 1/36 123/41.72 |
| 8,408,178 | B2 | 4/2013 | Xu et al. | |
| 10,107,228 | B2 | 10/2018 | Sharma et al. | |
| 2006/0037566 | A1 | 2/2006 | Sugano | |
| 2007/0240672 | A1 * | 10/2007 | Furuya | F02F 7/0021 123/195 R |
| 2008/0245320 | A1 | 10/2008 | Ishikawa | |
| 2013/0263812 | A1 | 10/2013 | Geyer et al. | |
| 2016/0273480 | A1 * | 9/2016 | Purcell | F16J 10/04 |
| 2016/0290276 | A1 * | 10/2016 | Nicosia | F02F 1/004 |
| 2021/0324816 | A1 | 10/2021 | Zhou et al. | |

FOREIGN PATENT DOCUMENTS

| | | | |
|---|---|---|---|
| GB | 2143899 | A | 2/1985 |
| JP | 2006002602 | | 1/2006 |
| WO | 2005068814 | | 7/2005 |
| WO | 2016159970 | | 10/2016 |
| WO | 2020131625 | | 6/2020 |

OTHER PUBLICATIONS

European Extended Search Report, Counter EP Appln. No. 19899832.0, Jun. 3, 2022, 6 pgs.

* cited by examiner

BLOCK RIBS FOR REDUCING LINER DISTORTION

CROSS-REFERENCE TO RELATED APPLICATIONS

The present application is a continuation-in-part of International Application No. PCT/US19/66271 filed on Dec. 13, 2019, which claims the benefit of the filing date of U.S. Provisional Application No. 62/781,943 filed on Dec. 19, 2018, each of which is incorporated herein by reference.

TECHNICAL FIELD

The present application relates generally to cylinder block walls for an internal combustion engine, and more particularly to a feature on the cylinder block walls partially surrounding a cylinder liner.

BACKGROUND

Internal combustion engines include one or more cylinders wherein each cylinder includes a piston in the cylinder bore. During the combustion cycle, the piston moves in an upstroke direction and a downstroke direction relative to the cylinder bore. Cylinder walls of the cylinder bore can become very worn or damaged from use. If the engine is not equipped with replaceable sleeves, there is a limit to how far the cylinder walls can be bored or worn before the block must be sleeved or replaced.

Cylinder wall thickness is important to efficient thermal conductivity in the engine. When choosing sleeves, engines have specifications to how thick the cylinder walls should be to prevent overworking the coolant system. Each engine's needs are different, depending on designed work load duty cycle and energy produced.

A cylinder liner is a cylindrical part to be fitted into an engine block to form a cylinder. The cylinder liner, serving as the inner wall of a cylinder, forms a sliding surface for the piston rings while retaining the lubricant within. The cylinder liner receives combustion heat through the piston and piston rings and transmits the heat to the coolant. The cylinder liner prevents the compressed gas and combustion gas from escaping outside. The cylinder liner should be designed such that it is hard to transform by high pressure and high temperature in the cylinder bore.

During operation of the piston in the combustion cycle, a liner seat of the cylinder liner can rotate which can cause the liner to buckle under load in the direction of the liner axis. Moreover, the liner can buckle due to loads from cylinder pressure or thermal expansion. If the liner is installed using press-fit or transitional fit techniques which can close under thermal or pressure-related expansion, then the liner may rotate about the cylinder axis or expand which decreases the durability of the liner.

Therefore, further contributions in this area of technology are needed to improve the durability of the cylinder block walls of the engine. Therefore, there remains a significant need for the apparatuses, methods and systems disclosed herein.

SUMMARY

A system, method, and apparatus that includes an engine block for an internal combustion engine is disclosed. The engine block includes one or more cylinder bores wherein each cylinder bore is surrounded by a cylinder bore wall.

The cylinder bore wall includes a liner stop mechanism configured to locate a liner in the cylinder bore. The cylinder bore includes a mid-portion that spans between an upper end and a lower end, wherein the liner stop mechanism can be located near the upper end, near the lower end, or in the mid-portion of the cylinder bore. The engine block has an outer cylinder block wall that is exterior to the cylinder bore wall.

In an embodiment, the outer cylinder block wall includes a first rib positioned above the liner stop mechanism and a second rib positioned below the liner stop mechanism relative to a cylindrical axis of the cylinder bore. The first and second ribs straddle the liner stop mechanism and reduce rotation of the liner seat hence reducing the propensity of the liner to buckle under load in the direction of the cylindrical axis of the cylinder bore, or due to loads from cylinder pressure or thermal expansion. The first and second ribs also act to reduce rotation or expansion of the liner wall where the liner is in contact with the engine block due to press-fit, or transitional fits which tend to close under thermal or pressure related expansion. The reduction or suppression of the liner by the first and second ribs improves the piston ring conformability wherein ring conformability is a function of the distortion of the cylinder bore and piston ring's ability to bend to these distortions. The reduction or suppression of the liner by the first and second ribs also improves the oil consumption of the engine.

In an embodiment, the outer cylinder block wall includes at least one rib with a first end above the liner stop mechanism and a second end below the liner stop mechanism. The width of the rib between the first and second ends spans the liner stop mechanism.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

BRIEF DESCRIPTION OF THE DRAWINGS

The concepts described herein are illustrative by way of example and not by way of limitation in the accompanying figures. For simplicity and clarity of illustration, elements illustrated in the figures are not necessarily drawn to scale. Where considered appropriate, references labels have been repeated among the figures to indicate corresponding or analogous elements.

DETAILED DESCRIPTION OF ILLUSTRATIVE EMBODIMENTS

Figure 1:
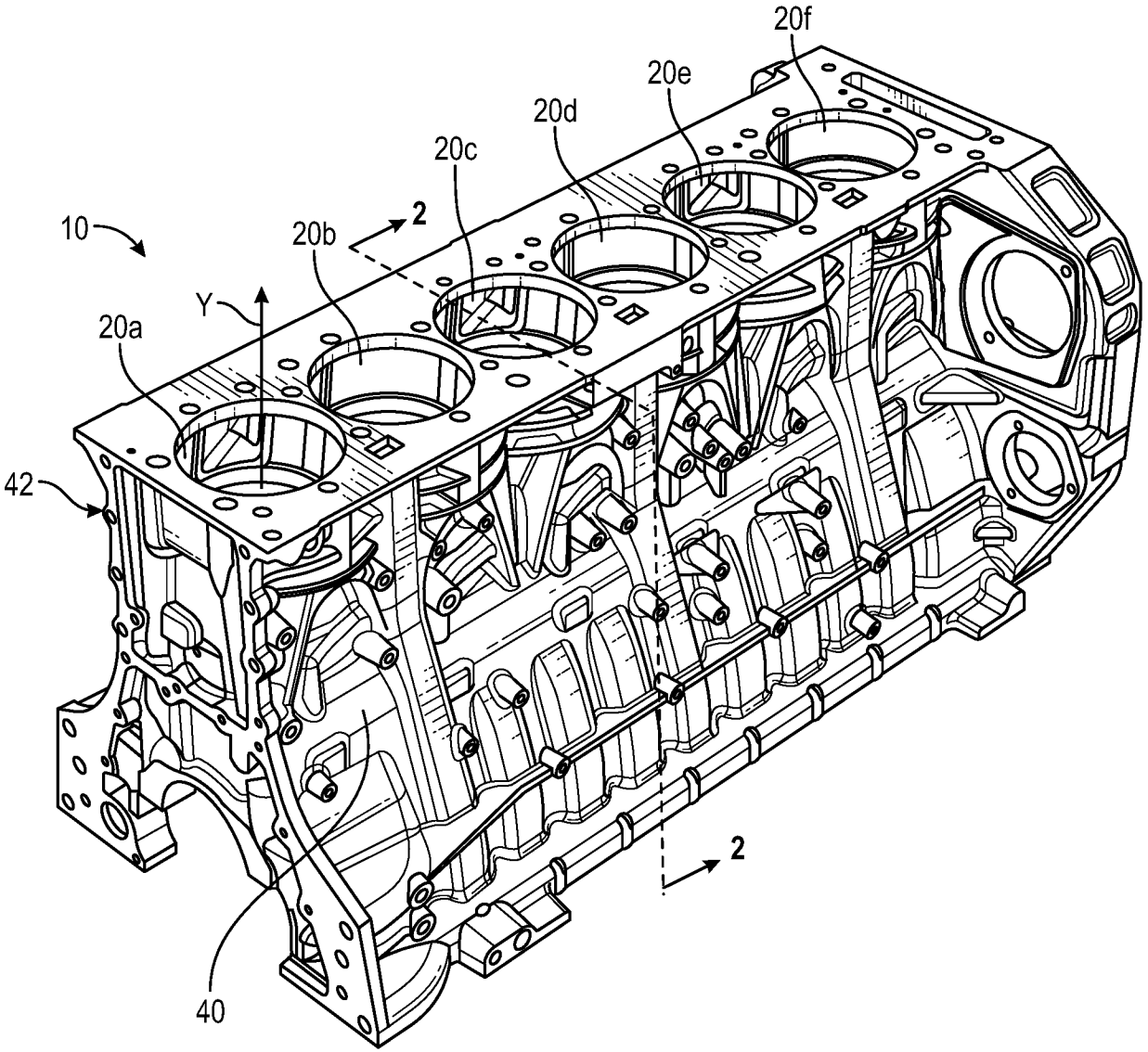
FIG. 1 is a perspective view of an engine assembly of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

A cylinder liner is a cylindrical part to be fitted into an engine block to form a cylinder. The cylinder liner, serving as the inner wall of a cylinder, forms a sliding surface for the piston rings while retaining the lubricant within. Some important functions of cylinder liners include an excellent sliding surface as well as high anti-galling properties, less wear on the cylinder liner itself, less wear on the partner piston ring, and less consumption of lubricant.

A cylinder liner or sleeve is installed by boring the cylinder to a size that is larger than normal inserted with an interference fit. Alternatively, the liners can be pressed into place, or they can be held in by a shrink fit. Cylinder wall thickness is important to efficient thermal conductivity in an internal combustion engine. When choosing sleeves, engines have specifications to how thick the cylinder walls should be to prevent overworking the coolant system. Each engine's needs are different, dependent on designed work load duty cycle and energy produced.

The cylinder liner receives combustion heat through the piston and piston rings and transmits the heat to the coolant. The cylinder liner prevents the compressed gas and combustion gas from escaping outside.

There are three types of liners. The engine can have a bore that is a liner in the base block or cylinder material, a dry liner which is a liner assembled into base block or cylinder without direct contact between coolant and liner, or a wet liner which is a liner assembled into base block or cylinder with direct contact between coolant and liner.

Moreover, there are three liner types including top, mid and bottom stop. Generally, the cylinder head sealing surface is called the top end of the engine. The top-stop liner concept includes a flange on the top of the liner with which it is located into the cylinder block. The mid-stop liner has a similar flange at or near the middle of the liner, and the bottom stop liner has its locating flange near the lower end of the liner. In any of the top, mid, and bottom stop liner configurations, the cylinder bore of the engine block includes a liner stop mechanism that is configured to receive the liner.

Turning now to FIG. 1, an engine block 10 is shown for an internal combustion engine (not illustrated). The engine is an internal combustion engine of any type, and can include a stoichiometric engine, a gasoline engine, alcohol engine (e.g. ethanol or methanol), or a natural gas engine. In the illustrated embodiment, the engine block 10 includes and at least partially defines six cylinder bores 20*a*, 20*b*, 20*c*, 20*d*, 20*e*, and 20*f*, in an in-line arrangement. However, the number of cylinders may be any number, and the arrangement of cylinders may be any arrangement, and is not limited to the number and arrangement shown in FIG. 1.

Figure 2:
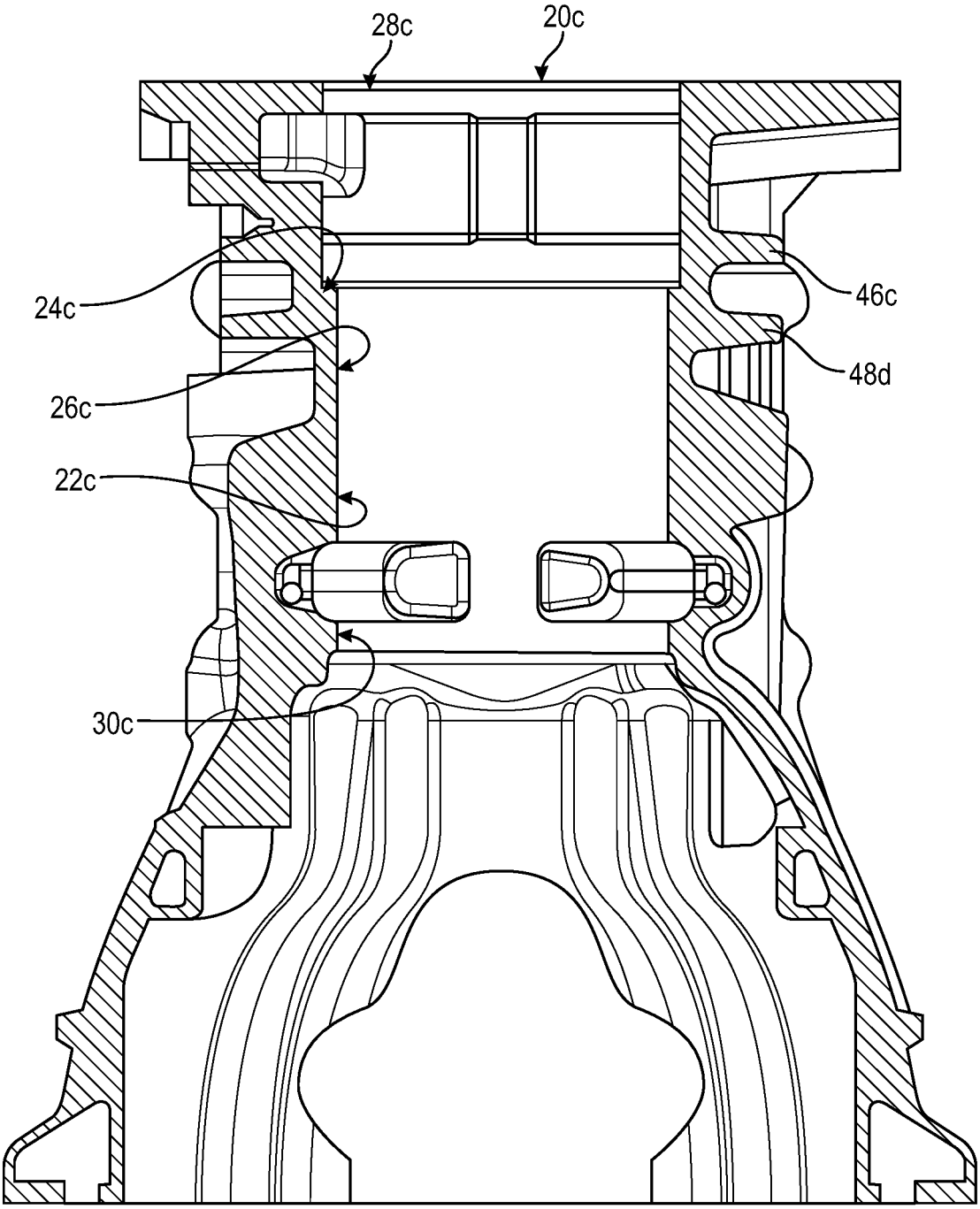
FIG. 2 is a cross-sectional view of the engine assembly of FIG. 1 of the present disclosure.

Each of the cylinder bores 20*a*-20*f* is surrounded by a cylinder bore wall, shown by cylinder bore wall 22*c* of cylinder bore 20*c* in FIG. 2, it being understood that cylinder bores 20*a*- 20*b* and 20*d*-20*f* can include a cylinder bore wall like cylinder bore wall 22*c* of cylinder bore 20*c*. Each of the cylinder bore walls of cylinder bores 20*a*-20*f* also includes a liner stop mechanism, such as shown with liner stop mechanism 24*c* of cylinder 20*c*, configured to locate a liner or sleeve (not illustrated) in the cylinder bores 20*a*-20*f*. The liner stop mechanism 24*c* in the illustrated embodiment is a lip, ledge, flange, rim, projecting edge, ridge or other configuration in the cylinder bore wall 22*c*. In other embodiments, the liner stop mechanism 24*c* can be configured differently to engage and retain the liner in the cylinder bore 20*c*. The cylinder bore wall 22*c* includes a mid-portion 26*c* that spans between an upper end 28*c* and a lower end 30*c*. A cylindrical axis Y (FIG. 1) spans between the upper and lower ends 28*c* and 30*c*. In the illustrated embodiment in FIG. 2, the liner stop mechanism 24*c* is located in the mid-portion 26*c* of the cylinder bore wall 22*c*. In other embodiments, the liner stop mechanism 24*c* is located at or near either the upper end 28*c* or the lower end 30*c* of the cylinder bore wall 22*c*. The other cylinders 20*a*-20*b*, and 20*d*-20*f* may have liner stop mechanisms similarly positioned as described for liners stop mechanism 24*c*.

Each of the cylinder bores 20*a*-20*f* is configured to receive a cylinder liner (not illustrated) to define a combustion chamber. A piston (not shown) may be slidably disposed within each of the liners in the cylinder bores 20*a*-20*f* to reciprocate between a top-dead-center position and a bottom-dead-center position, and a cylinder head (not shown) may be associated with each of the cylinder bores 20*a*-20*f*. Each of the cylinder bores 20*a*-20*f*, its respective piston, and the cylinder head form a combustion chamber. In the illustrated embodiment, engine block 10 includes six such combustion chambers. However, it is contemplated that engine block 10 may include a greater or lesser number of cylinders and combustion chambers and that the cylinders and combustion chambers may be disposed in an "in-line" configuration, a "V" configuration, or in any other suitable configuration.

Cylinder liners may be inserted into cylinder bores 20*a*-20*f* under a variety of conditions. One such condition is a press fit, also known as an interference fit or friction fit, for example, creates an axial hold where adjoining parts share the same space by creating a slight elastic deformation and a compression force between the adjoining parts. Compression from the press fit increases the friction between the adjoining parts to a point where independent movement of the adjoining parts is not possible under normal operating conditions. Press fits between the cylinder liner and engine block 10 may be created using physical presses, principles of thermal expansion or other suitable method.

Figure 3:
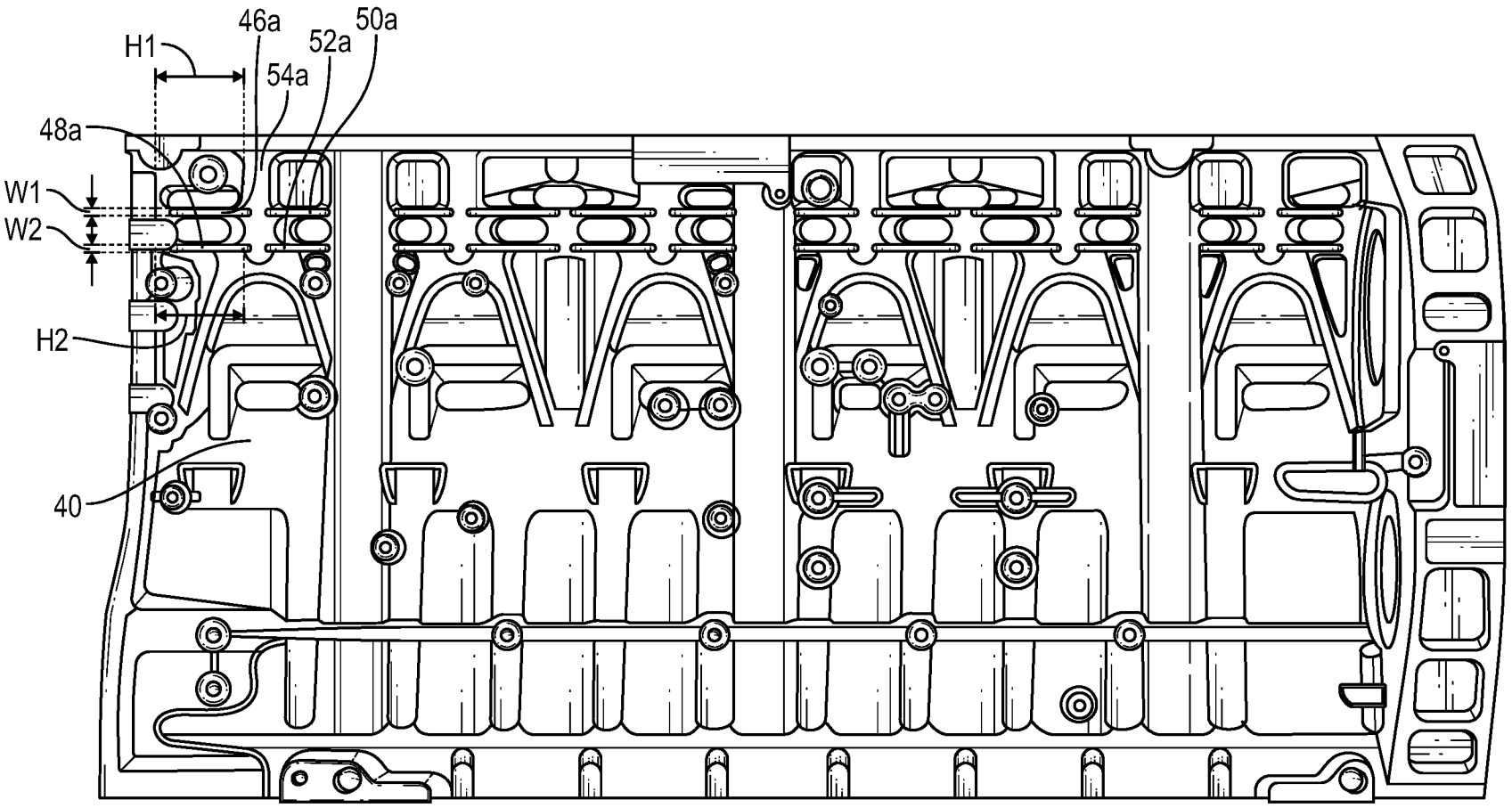
FIG. 3 is a right side view of the engine assembly of FIG. 1 of the present disclosure.
Figure 4:
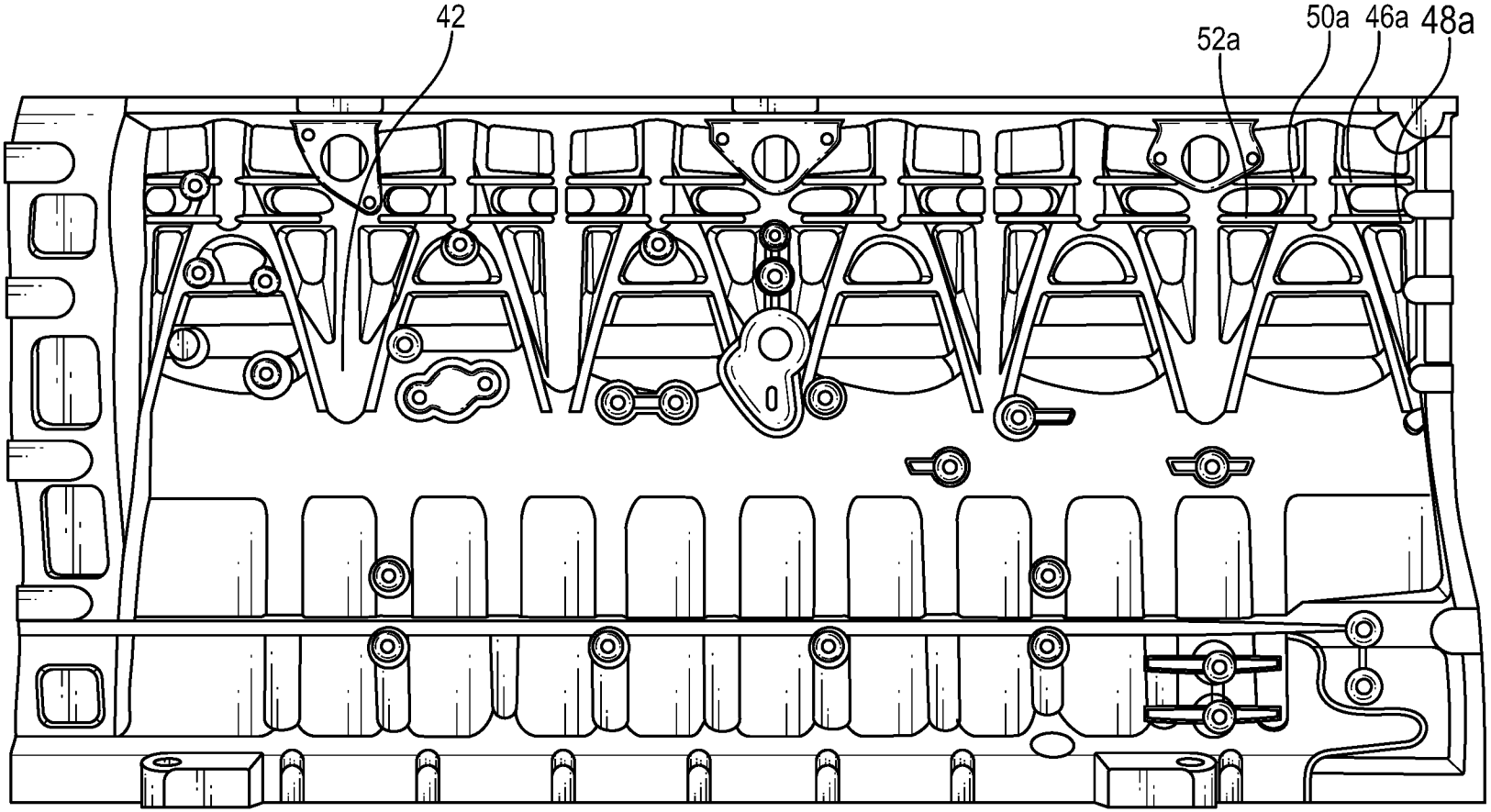
FIG. 4 is a left side view of the engine assembly of FIG. 1 of the present disclosure.

As illustrated in FIGS. 3 and 4, the engine block 10 includes a first outer cylinder block wall 40 opposite a second outer cylinder block wall 42 with the cylinders bores 20*a*-20*f* between the first and second outer cylindrical block walls 40 and 42. Each of the first and second outer cylinder block walls 40 and 42 surround at least a portion of the cylinder bore walls of the cylinders bores 20*a*-20*f*. The first outer cylinder block wall 40 includes a first rib 46*a* positioned above the liner stop mechanism 24*a* of cylinder bore 20*a* and a second rib 48*a* positioned below the liner stop mechanism 24*a* of cylinder bore 20*a* relative to the cylindrical axis Y of the cylinder bore 20*a*. In the illustrated embodiment, the first outer cylinder block wall 40 also includes a third rib 50*a* positioned above the liner stop mechanism 24*a* and a fourth rib 52*a* positioned below the liner stop mechanism 24*a* relative to the cylindrical axis Y of the cylinder bore 20*a*. A head boss 54*a* is positioned between the first and third ribs 46*a* and 50*a* and the second and fourth ribs 48*a* and 52*a*.

In other forms, the first and third ribs 46*a* and 50*a* may be one monolithic rib without the presence of the head boss 54*a*. Similarly, the second and fourth ribs 48*a* and 52*a* may be one monolithic rib without the presence of the head boss 54*a*. As such, the first and third ribs 46*a* and 50*a* form a single rib that is located above the liner stop mechanism 24*a*. Similarly, the second and fourth ribs 48*a* and 52*a* form a single rib that is located below the liner stop mechanism 24*a*. In yet other forms, the first and third ribs 46*a* and 50*a* may be a single rib and the second and fourth ribs 48*a* and 52*a* may be separate ribs, or vice versa. The second outer cylinder block wall 42 also includes similar first and second ribs as described with respect to the first outer cylinder block wall 40 therefore for the sake of brevity these will not be described again.

The first outer cylindrical block wall 40 includes additional first and second ribs similar to first and second ribs 46*a* and 48*a* for each of the remaining cylinder bores 20*b*-20*f*. The first outer cylindrical block wall 40 includes additional third and fourth ribs similar to third and fourth ribs 50*a* and 52*a* for each of the remaining cylinder bores 20*b*-20*f*. The additional first, second, third and fourth ribs will not be described for the sake of brevity.

The first, second, third, and fourth ribs 46*a*, 48*a*, 50*a*, and 52*a* generally follow the circumference of cylinder bore 20*a* or the liner that would be installed therein. The first rib 46*a* is placed above the liner stop mechanism 24*a* and the second rib 48*a* is positioned below the liner stop mechanism 24*a*, with a space there between in the direction of the cylindrical axis Y. The first and second ribs 46*a* and 48*a* act to reduce rotation of a liner seat of a liner installed in the cylinder bore 20*a* and reduce the propensity of the liner to buckle under loads in the direction of a liner axis, or due to loads from cylinder pressure or thermal expansion. The first and second ribs 46*a* and 48*a* also act to reduce rotation or expansion of a liner wall of the liner, where the liner is in contact with the engine block 10 due to press-fit, or transitional fits which typically close under thermal or pressure related expansion.

In one form, the first rib 46*a* and the third rib 50*a* are positioned closer to the liner stop mechanism 24*a* than the second rib 48*a* and the fourth rib 52*a* as measured relative to the cylindrical axis Y. In another form, the second rib 48*a* and fourth rib 52*a* are positioned closer to the liner stop mechanism 24*a* than the first rib 46*a* and the third rib 50*a* as measured relative to the cylindrical axis Y. In yet another embodiment, the first, second, third, and fourth ribs 46*a*, 48*a*, 50*a*, and 52*a* are positioned equidistant from the liner stop mechanism 24*a* as measured relative to the cylindrical axis Y.

The first rib 46*a* has a first width W1 and the second rib 48*a* has a second width W2 wherein the first rib 46*a* and the second rib 48*a* extend in a direction of the cylindrical axis Y of the cylinder bore 20*a*. In one form, the first width W1 and the second width W2 are the same, in other forms they are different. The first rib 46*a* has a first height H1 and the second rib 48*a* has a second height H2 such that the first and the second ribs 46*a* and 48*a* extend in a direction perpendicular to the cylindrical axis Y of the cylinder bore 20*a*. The third rib 50*a* is similar to the first rib 46*a*, and the fourth rib 52*a* is similar to the second rib 48*a*.

The unique configuration of the first, second, third, and fourth ribs 46*a*, 48*a*, 50*a*, and 52*a* of the first outer cylinder block wall 40 and the corresponding ribs on the second outer cylinder block wall 42 that surround or partially surround the wet cylinder liner in the cylinder bore 20*a* beneficially reduce deformation or distortion of the wet cylinder liner under installation and operating conditions. The first, second, third, and fourth ribs 46*a*, 48*a*, 50*a*, and 52*a* of the first outer cylinder block wall 40 and the corresponding ribs on the second outer cylinder block wall 42 also reduce engine oil consumption and can apply on top, mid or bottom stop liner configurations. Moreover the first, second, third, and fourth ribs 46*a*, 48*a*, 50*a*, and 52*a* do not add too much weight or cost to manufacture. The first, second, third, and fourth ribs 46*a*, 48*a*, 50*a*, and 52*a* are also easy to manufacture for gray iron block casting.

Figure 5:
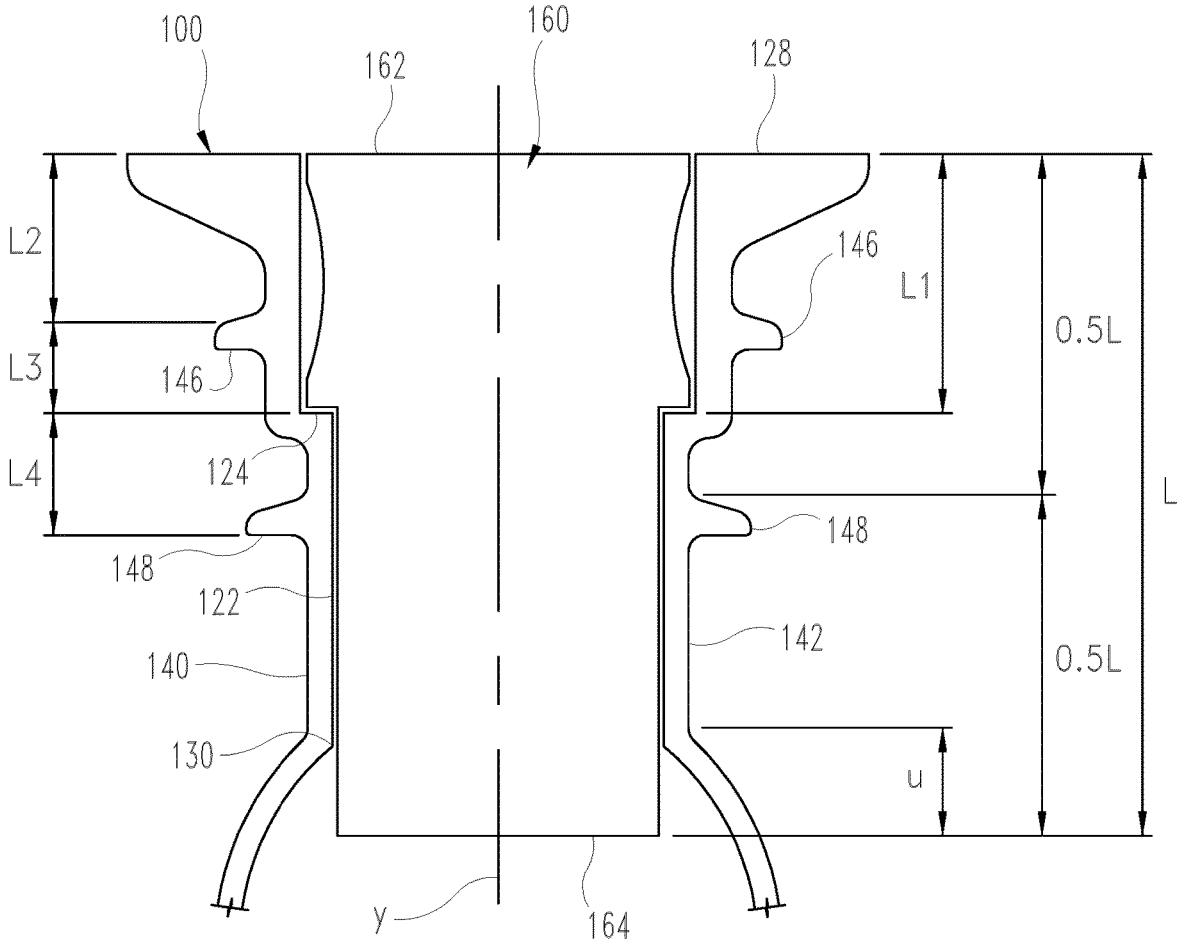
FIG. 5 is another cross-sectional view of the engine assembly of the present disclosure.

Referring to FIG. 5, another block having supports for a cylinder liner stop mechanism is shown. Engine block 100 can be similar to block 10 discussed above, and includes at least one cylinder bore 120 with a cylinder bore wall 122 having a liner stop mechanism 124. A cylinder liner 160 is shown in cylinder bore 120 that is supported on liner stop mechanism 124. Cylinder bore 120 extends from an upper end 128 at the top of, or at the cylinder head sealing surface of, block 100 and into the block 100 to a lower end 130 of the cylinder bore wall 122.

Cylinder liner 160 extends from an upper liner end 162 located at upper end 128 of the cylinder bore wall 122 to a lower liner end 164 located below lower end 130 of bore 120. In FIG. 5, the distance between upper and lower ends 162, 164 along cylinder axis Y is designated by length L. The mid-point M of the length L of cylinder liner 140 is shown located at a distance of 0.5 L below upper end 128. The lower part of cylinder liner 160 may include an unsupported length U that projects below lower end 130. In an embodiment, the unsupported length U is no more than 25% of the overall length L of cylinder liner 160.

Liner stop mechanism 124 is located above the mid-point of the cylinder liner in the illustrated embodiment. The location of liner stop mechanism 124 is a distance L1 from upper end 128 of cylinder bore wall 122. Distance L1 is less than 0.5 L and above the mid-point M. In an embodiment, distance L1 is less than 50% of length L and more than 10% of length L. In an embodiment, distance L1 is less than 40% of length L and more than 10% of length L. In an embodiment, distance L1 is less than 30% of length L and more than 10% of length L. In an embodiment, the distance L1 is such that the liner stop mechanism 124 is positioned above the location of the maximum side thrust of the piston so that thrust force is directed to the location of liner stop mechanism 124.

The engine block 100 includes a first outer cylinder block wall 140 that is opposite a second outer cylinder block wall 142 with the cylinder bore(s) 120 between the first and second outer cylindrical block walls 140 and 142. Each of the first and second outer cylinder block walls 140 and 142 surround at least a portion of the cylinder bore walls of the cylinders bore(s) 120. The first outer cylinder block wall 140 includes at least one rib 146 positioned above the liner stop mechanism 124 of cylinder bore 120 and at least one rib 148 positioned below the liner stop mechanism 124 of cylinder bore 120. As discussed above, it is contemplated that rib 146 and/or rib 148 may include multiple ribs that are positioned about the cylinder bore 120. In addition, a head boss or other structure on wall 140, 142 may interrupt one or more of the ribs 146, 148.

Figure 6A:
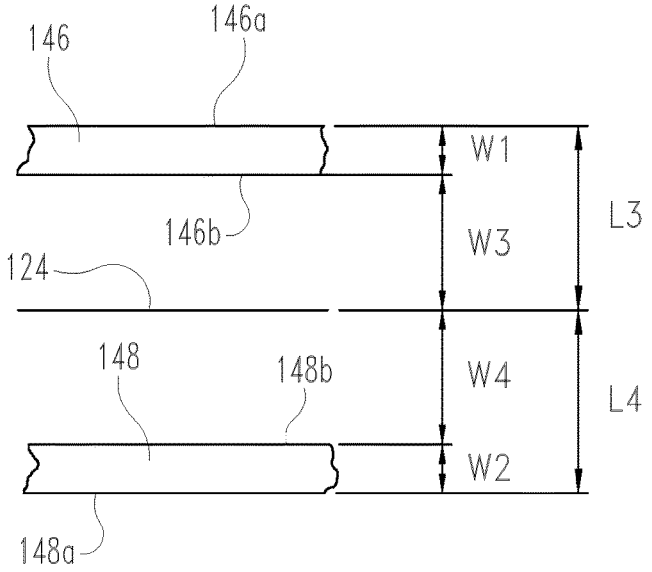
FIGS. 6A and 6B are schematic diagrams of the ribs and the cylinder bore.

As also shown in FIG. 6A, rib 146 has an upper side 146*a* positioned a distance L3 above liner stop mechanism 124. Upper side 146*a* is also located a distance L2 below upper end 128. An area of reduced wall thickness is provided along distance L2 to upper side 146*a*. Rib 148 has a lower side 148*a* positioned a distance L4 below liner stop mechanism 124. The rib 146 has a width W1 from upper side 146*a* to a lower side 146*b* thereof. The rib 148 has a width W2 from lower side 148*a* to an upper side 148*b* thereof. The lower side 146*b* of rib 146 is spaced from liner stop mechanism 124 by a distance W3, and the lower side 148*a* of rib 148 is spaced from liner stop mechanism 124 by a distance W4. Areas of reduced wall thickness, as compared to the outwardly projecting thickness of ribs 146, 148, are provided along distances W3 and W4 of walls 140, 142. An area of reduced wall thickness is also provided below rib 148.

Figure 6B:
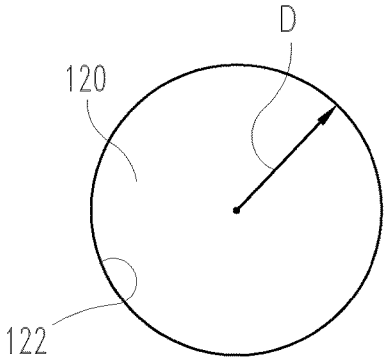

In an embodiment, distance W3 and W4 vary between upper and lower limits. In an embodiment, W3 and W4 can vary from 5 millimeters to 20 millimeters. In an embodiment, W3 and W4 are not the same distance but both are between the upper and lower limits. In an embodiment, W3 and W4 are the same distance and are between the upper and lower limits. In an embodiment, W3 and W4 are selected or determined as a function of a cylinder bore diameter D of cylinder bore 120. For example, the cylinder bore 120 includes a diameter D (FIG. 6B) defined by cylinder bore wall 122. The distance W3 and/or W4 can be selected as a function of the bore diameter D. For example, the distance W3 and/or W4 can increase parametrically from their minimum distance as the bore diameter D increases. Widths W1 and/or W2 of ribs 146 and/or 148, however, can remain constant regardless of the bore diameter D. In an embodiment, widths W1 and W2 are selected so that distances W3 and/or W4 are maintained between their upper and lower limits, and distance L2 is at least five millimeters.

In an embodiment, distance W1+W3 and distance W2+W4 vary between upper and lower limits. In an embodiment, W1+W3 and W2+W4 can vary from more than 5 millimeters to 20 millimeters. In an embodiment, W1+W3 and W2+W4 are not the same distance but both are between the upper and lower limits. In an embodiment, W1+W3 and W2+W4 are selected as a function of a cylinder bore diameter D of cylinder bore 120, and/or can increase parametrically as a cylinder bore diameter D increases.

Figure 7:
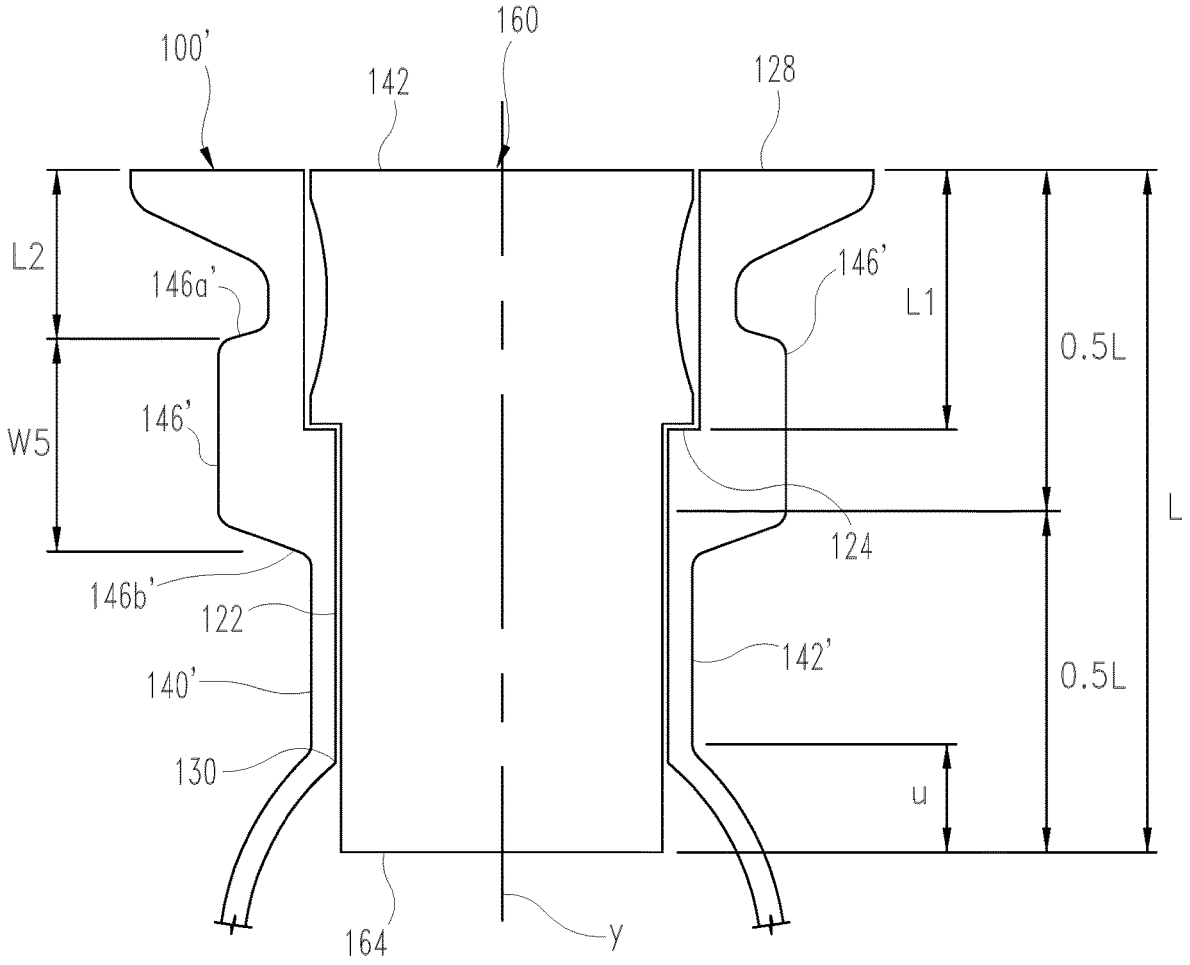
FIG. 7 is a cross-sectional of another embodiment of the engine assembly of the present disclosure.

Referring to FIG. 7, another embodiment engine block 100' is shown that is similar to engine block 100, except that each of the cylinder block walls 140', 142' includes a single rib 146'. Each rib 146' spans the liner stop mechanism 124 along the respective wall 140', 142', and extends from an upper side 146*a*' to a lower side 146*b*' thereof. Each rib 146' includes a width W5 from the upper side 146*a*' to the lower side 146*b*'. Walls 140', 142' have a reduced thickness compared to ribs 146' in the regions above and below ribs 146'.

The width W5 is selected so that upper side 146*a*' is a minimum distance above liner stop mechanism 124, and lower side 146*b*' is a minimum distance below liner stop mechanism 124. The minimum distance above and below liner stop mechanism 124 can be, for example, 5 millimeters in one embodiment, so that the overall width W5 is at least 10 millimeters. However, upper side 146*a*' and lower side 146*b*' can be located at different distances above and below liner stop mechanism 124 so long as a minimum distance is maintained. The width W5 can also be selected as a function of the bore diameter D. For example, width W5 can increase parametrically from the minimum width W5 as the bore diameter D increases.

As is evident from the figures and text presented above, a variety of aspects of the present disclosure are contemplated. According to one aspect, an apparatus comprising an engine block for an internal combustion engine, the engine block having a cylinder bore surrounded by a cylinder bore wall, the cylinder bore wall including a liner stop mechanism configured to locate a liner in the cylinder bore, the engine block having an outer cylinder block wall that surrounds at least a portion of the cylinder bore wall, the outer cylinder block wall including a first rib positioned above the liner stop mechanism and a second rib positioned below the liner stop mechanism relative to a cylindrical axis of the cylinder bore.

In one embodiment, the first rib is positioned closer to the liner stop mechanism than the second rib. In one embodiment, the second rib is positioned closer to the liner stop mechanism than the first rib. In one embodiment, the first rib and the second rib are positioned equidistant from the liner stop mechanism.

In one embodiment, the first rib has a first width and the second rib has a second width, the first and the second ribs extend in a direction of the cylindrical axis of the cylinder bore. In a refinement of this embodiment, the first width and the second width are the same.

In one embodiment, the first rib has a first height and the second rib has a second height, the first and the second ribs extend in a direction perpendicular to the cylindrical axis of the cylinder bore. In one embodiment, the outer cylinder block wall includes a first outer cylinder block wall and a second outer cylinder block wall, and each of the first and the second outer cylinder block walls includes the first and second ribs. In one embodiment, the cylinder bore includes a mid-portion that spans between an upper end and a lower end, the liner stop mechanism being located near the upper end of the cylinder bore.

In one embodiment, the cylinder bore includes a mid-portion that spans between an upper end and a lower end, the liner stop mechanism being located in the mid-portion of the cylinder bore. In one embodiment, the cylinder bore includes a mid-portion that spans between an upper end and a lower end, the liner stop mechanism being located near the lower end of the cylinder bore. In one embodiment, further comprises a liner assembled in the cylinder bore.

According to another aspect, an apparatus comprising an engine block for an internal combustion engine, the engine block having at least one cylinder bore surrounded by a cylinder bore wall, the cylinder bore wall including a liner stop mechanism configured to locate a liner in the cylinder bore, the engine block having an outer cylinder block wall with a first rib and a second rib arranged to straddle the liner stop mechanism exteriorly of the cylinder bore wall.

In one embodiment, the first rib is positioned closer to the liner stop mechanism than the second rib. In one embodiment, the second rib is positioned closer to the liner stop mechanism than the first rib. In one embodiment, the first rib and the second rib are positioned equidistant from the liner stop mechanism.

In one embodiment, the first rib has a first width and the second rib has a second width, the first and the second ribs extend in a direction of the cylindrical axis of the cylinder bore. In one embodiment, the first rib has a first height and the second rib has a second height, the first and the second ribs extend in a direction perpendicular to the cylindrical axis of the cylinder bore. In one embodiment, the at least one cylinder bore includes a plurality of cylinder bores arranged in line, each of the cylinder bores having a set of the first and second ribs wherein a first set of the first and second ribs extend towards an adjacent set of the first and second ribs.

In one embodiment, the outer cylinder block wall includes a first outer cylinder block wall and a second outer cylinder block wall, and each of the first and the second outer cylinder block walls includes the first and second ribs. In one embodiment, the cylinder bore includes a mid-portion that spans between an upper end and a lower end, the liner stop mechanism being located near the upper end of the cylinder bore. In one embodiment, the cylinder bore includes a mid-portion that spans between an upper end and a lower end, the liner stop mechanism being located in the mid-portion of the cylinder bore.

In one embodiment, the cylinder bore includes a mid-portion that spans between an upper end and a lower end, the liner stop mechanism being located near the lower end of the cylinder bore. In one embodiment, further comprises a liner assembled in the cylinder bore. In one embodiment, the first rib includes two ribs and the second rib includes two ribs.

In the above description, certain relative terms may be used such as "up," "down," "upper," "lower," "horizontal," "vertical," "left," "right," "proximal," "distal," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In some instances, the benefit of simplicity may provide operational and economic benefits and exclusion of certain elements described herein is contemplated as within the scope of the invention herein by the inventors to achieve such benefits. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising: an engine block including a cylinder bore wall defining a cylinder bore that extends from an upper end of the engine block to a lower end of the cylinder bore within the engine block, the cylinder bore wall including a liner stop mechanism that locates and supports a liner with a press fit on the liner stop mechanism in the cylinder bore at a location along a length of the liner, the engine block having an outer cylinder block wall along at least a portion of the cylinder bore wall, the outer cylinder block wall including one or more ribs projecting outwardly from the cylinder block wall, the one or more ribs including an upper surface positioned a first distance above the liner stop mechanism and an opposite lower surface positioned a second distance below the liner stop mechanism, wherein the upper surface is also positioned a third distance below the upper end of the engine block and the lower surface is located above the lower end of the cylinder bore, wherein: the length of the liner extends from an upper end of the liner located at the upper end of the engine block to a lower end of the liner located below the lower end of the cylinder bore such that the liner includes an unsupported length extending below the lower end of the cylinder bore; and the outer cylinder block wall includes a first wall on one side of the cylinder bore and a second wall on an opposite side of the cylinder bore, and further comprising one or more ribs on each of the first and second walls.

2. The apparatus of claim 1, wherein at least one of the first and second distances is based on a diameter of the cylinder bore.

3. The apparatus of claim 2, wherein the at least one of the first and second distances increases parametrically as the diameter of the cylinder bore increases.

4. The apparatus of claim 1, wherein the one or more ribs includes a first rib positioned above the liner stop mechanism and a second rib positioned below the liner stop mechanism, the first rib including the upper surface and the second rib including the lower surface.

5. The apparatus of claim 4, wherein the first rib includes a second lower surface opposite the upper surface and the second rib includes a second upper surface opposite the lower surface, wherein the second lower surface of the first rib is spaced a minimum distance above the liner stop mechanism and the lower surface of the second rib is spaced a minimum distance below the liner stop mechanism.

6. The apparatus of claim 5, wherein the minimum distance is 5 millimeters.

7. The apparatus of claim 5, wherein the second lower surface of the first rib is spaced a maximum distance above the liner stop mechanism and the lower surface of the second rib is spaced a maximum distance below the liner stop mechanism.

8. The apparatus of claim 7, wherein the maximum distance is 20 millimeters.

9. The apparatus of claim 1, wherein the location of the liner stop mechanism is above a mid-point of the length of the liner.

10. The apparatus of claim 9, wherein the unsupported length is 25% of the length of the cylinder liner.

11. The apparatus of claim 1, wherein the at least one rib is a single rib that spans the liner stop mechanism and extends from the upper surface to the lower surface.

12. An apparatus, comprising:

an engine block including a cylinder bore wall defining a cylinder bore that extends from an upper end of the engine block to a lower end of the cylinder bore within the engine block, the cylinder bore wall including a liner stop mechanism that locates and supports a liner with a press fit on the liner stop mechanism in the cylinder bore at a location along a length of the liner, the engine block having an outer cylinder block wall along at least a portion of the cylinder bore wall, the outer cylinder block wall including a first rib projecting outwardly from the cylinder block wall that is located a first distance above the liner stop mechanism and a second rib positioned a second distance below the liner stop mechanism, wherein the first rib is also positioned a third distance below the upper end of the engine block and the second rib is positioned above the lower end of the cylinder bore.

13. The apparatus of claim 12, wherein the first, second, and third distances are each at least 5 millimeters.

14. The apparatus of claim 12, wherein the first and second distances are different.

15. The apparatus of claim 12, wherein at least one of the first and second distances is based on a diameter of the cylinder bore.

16. The apparatus of claim 15, wherein the at least one of the first and second distances increases parametrically as the diameter of the cylinder bore increases.

17. An apparatus, comprising: an engine block including a cylinder bore wall defining a cylinder bore that extends from an upper end of the engine block to a lower end of the cylinder bore within the engine block, the cylinder bore wall including a liner stop mechanism that locates and supports a liner with a press fit on the liner stop mechanism in the cylinder bore at a location along a length of the liner, the engine block having an outer cylinder block wall forming a first wall and a second wall along opposite sides of the cylinder bore wall, each of the first and second walls including a single rib projecting outwardly therefrom that spans the liner stop mechanism, each of the ribs forming an upper surface positioned a first minimum distance above the liner stop mechanism and an opposite lower surface positioned a second minimum distance below the liner stop mechanism, wherein the upper surface is also positioned a third distance below the upper end of the engine block and the lower surface is positioned above the lower end of the cylinder bore, wherein: the length of the liner extends from an upper end of the liner located at the upper end of the engine block to a lower end of the liner located below the lower end of the cylinder bore such that the liner includes an unsupported length extending below the lower end of the cylinder bore; and the outer cylinder block wall includes a first wall on one side of the cylinder bore and a second wall on an opposite side of the cylinder bore, and further comprising a single rib on each of the first and second walls.

18. The apparatus of claim 17, wherein at least one of the first and second minimum distances increases as a diameter of the cylinder bore increases.

19. The apparatus of claim 17, wherein the first and second minimum distances are at least 5 millimeters.

* * * * *